US010814240B2

(12) United States Patent
Cai

(10) Patent No.: US 10,814,240 B2
(45) Date of Patent: Oct. 27, 2020

(54) CHILD-MOTHER TOY

(71) Applicants: ALPHA GROUP CO., LTD., Shantou (CN); GUANGDONG AULDEY ANIMATION & TOY CO., LTD., Guangzhou (CN); GUANGZHOU ALPHA CULTURE COMMUNICATIONS CO., LTD., Guangdong (CN)

(72) Inventor: Dongqing Cai, Shantou (CN)

(73) Assignees: ALPHA GROUP CO., LTD., Shantou (CN); GUANGDONG AULDEY ANIMATION & TOY CO., LTD., Guangzhou (CN); GUANGZHOU ALPHA CULTURE COMMUNICATIONS CO., LTD., Guangdong (CN)

( * ) Notice: Subject to any disclaimer, the term of this patent is extended or adjusted under 35 U.S.C. 154(b) by 0 days.

(21) Appl. No.: 16/337,286

(22) PCT Filed: May 17, 2017

(86) PCT No.: PCT/CN2017/084640
§ 371 (c)(1),
(2) Date: Mar. 27, 2019

(87) PCT Pub. No.: WO2018/058971
PCT Pub. Date: Apr. 5, 2018

(65) Prior Publication Data

US 2020/0030709 A1 Jan. 30, 2020

(30) Foreign Application Priority Data

Sep. 28, 2016 (CN) ..... 2016 2 1088779 U

(51) Int. Cl.
*A63H 17/00* (2006.01)
*A63H 33/00* (2006.01)
*A63H 17/26* (2006.01)

(52) U.S. Cl.
CPC ..... *A63H 33/003* (2013.01); *A63H 17/002* (2013.01); *A63H 17/26* (2013.01); *A63H 33/005* (2013.01)

(58) Field of Classification Search
CPC ..... A63H 17/008; A63H 17/02; A63H 17/26; A63H 33/003
(Continued)

(56) References Cited

U.S. PATENT DOCUMENTS 2,597,094 A * 5/1952 Gutmann ..... A63H 29/04 446/6
4,192,093 A * 3/1980 Hamano ..... A63H 17/00 446/427

(Continued)

FOREIGN PATENT DOCUMENTS

CN 102218218 10/2011
CN 203287696 11/2013

(Continued)

OTHER PUBLICATIONS

International Search Report for PCT/CN2017/084640, dated Aug. 10, 2017.

(Continued)

*Primary Examiner* — Alexander R Niconovich
(74) *Attorney, Agent, or Firm* — B. Aaron Schulman, Esq.; Stites & Harbison, PLLC

(57) ABSTRACT

The present disclosure provides a child-mother toy, including: a first assembly and a second assembly. The second assembly includes a supporting member, a triggering subassembly, a unfolding subassembly and an ejection subas-
(Continued)

sembly, and the triggering subassembly, the unfolding subassembly and the ejection subassembly are disposed to the supporting member. Before the triggering subassembly is triggered, the unfolding subassembly is folded at the supporting member so as to define an accommodating cavity together with the supporting member, the accommodating cavity is configured to accommodate the first assembly therein; and after the triggering subassembly is triggered, the unfolding subassembly is unfolded to open the accommodating cavity, and meanwhile the ejection subassembly ejects the first assembly out of the accommodating cavity.

20 Claims, 12 Drawing Sheets

(58) Field of Classification Search
USPC ..... 446/71, 310, 376, 429, 435, 470, 487
See application file for complete search history.

(56) References Cited

U.S. PATENT DOCUMENTS 4,433,504 A * 2/1984 Terui ..... A63H 17/44 446/429
4,453,340 A * 6/1984 Kozuka ..... A63H 17/40 446/288
4,464,860 A * 8/1984 Onodera ..... A63H 29/24 238/10 R
4,477,999 A * 10/1984 Harigai ..... A63H 33/003 446/470
4,655,727 A * 4/1987 Swisher ..... A63H 33/003 446/470
4,740,187 A * 4/1988 Rasmussen ..... A63H 17/44 206/457
5,816,888 A * 10/1998 Myers ..... A63H 17/004 446/456
6,672,937 B1 * 1/2004 Motosko ..... A63H 17/26 446/431
6,761,612 B1 * 7/2004 Pencil ..... A63H 13/16 40/411
7,008,289 B2 * 3/2006 Norman ..... A63H 3/18 446/308
7,387,558 B2 * 6/2008 Swisher ..... A63H 17/02 446/427
7,607,961 B2 * 10/2009 Lorelli ..... A63H 17/02 446/454
7,762,867 B2 * 7/2010 Agostini ..... A63H 5/00 446/431
7,785,168 B2 * 8/2010 Yamada ..... A63H 33/26 446/376
7,942,721 B2 * 5/2011 Wade ..... A63H 33/009 446/473
7,950,977 B2 * 5/2011 Sun ..... A63H 17/21 446/435
8,066,542 B2 * 11/2011 Ejima ..... A63H 33/003 446/93
8,075,364 B2 * 12/2011 Wai ..... A63H 27/14 446/75
8,216,020 B2 * 7/2012 Zimet ..... A63H 17/02 446/433
8,376,806 B2 * 2/2013 Sun ..... A63H 27/004 446/431
8,517,790 B2 * 8/2013 Rehkemper ..... A63H 1/02 446/259
8,657,642 B2 2/2014 Magot
8,784,153 B2 * 7/2014 Sugimoto ..... A63H 33/003 446/72
8,801,489 B2 * 8/2014 Koshida ..... A63H 17/004 446/71
8,974,264 B2 * 3/2015 McCafferty ..... A63H 13/16 446/429
8,992,284 B2 * 3/2015 Weidetz ..... A63H 33/003 446/310
8,998,673 B2 * 4/2015 Martinez ..... F41B 3/04 446/429
9,573,072 B2 * 2/2017 Cai ..... A63H 17/02
2006/0270310 A1 * 11/2006 Campbell ..... A63H 33/003 446/268
2009/0233519 A1 * 9/2009 Ejima ..... A63H 33/003 446/376
2011/0070801 A1 * 3/2011 Furusawa ..... A63H 17/004 446/71
2011/0111672 A1 * 5/2011 Miyake ..... A63H 17/02 446/378
2012/0252313 A1 * 10/2012 Magot ..... A63H 17/02 446/454
2013/0078885 A1 * 3/2013 Hudson ..... A63H 17/008 446/236
2013/0244535 A1 * 9/2013 Martinez ..... A63H 17/006 446/330
2014/0051325 A1 * 2/2014 Paukert ..... A63H 33/003 446/297
2015/0050859 A1 * 2/2015 Choi ..... A63F 1/06 446/72
2015/0196850 A1 * 7/2015 Kobayashi ..... A63H 33/003 446/376
2019/0201798 A1 * 7/2019 Cai ..... A63H 17/006

FOREIGN PATENT DOCUMENTS

CN 204522293 8/2015
CN 104922910 9/2015
WO WO-2012050230 4/2012
WO WO-2012131494 10/2012

OTHER PUBLICATIONS

Written Opinion of the International Searching Authority for PCT/CN2017/084640, dated Aug. 17, 2017.
Extended European Search Report dated Mar. 31, 2020 in corresponding European Application No. 17854427.6.

* cited by examiner

CHILD-MOTHER TOY

CROSS-REFERENCE TO RELATED APPLICATION

The present application is a national phase entry under 35 USC § 371 of International Application PCT/CN2017/084640, filed May 17, 2017, which claims the benefit of and priority to Chinese Patent Application No. 201621088779.8, filed Sep. 28, 2016, the entire disclosures of which are incorporated herein by reference.

FIELD

The present disclosure relates to a technical field of toy, and more particularly to a child-mother toy.

BACKGROUND

A toy in the related art usually adopts a gear box and a motor, or circuit control to realize a plurality of continuous actions. On one hand, since the gear box and the motor have high manufacturing cost and high defective rate, and may adversely affect the environment, thereby increasing the overall price of the toy. On the other hand, due to the complicated design, the troublesome operation, and the high failure rate of the circuit control, the overall price of the toy is raised, and the service life of the toy is lowered.

SUMMARY

The present disclosure aims to solve at least one of the technical problems existing in the related art. Accordingly, the present disclosure provides a child-mother toy, which has a simple structure, high entertainment, high action reliability, low cost, and is suitable for batch production.

The child-mother toy according to the present disclosure includes a first assembly and a second assembly. The second assembly includes a supporting member, a triggering subassembly, an unfolding subassembly and an ejection subassembly, and the triggering subassembly, the unfolding subassembly and the ejection subassembly are disposed to the supporting member. Before the triggering subassembly is triggered, the unfolding subassembly is folded at the supporting member so as to define an accommodating cavity together with the supporting member, the accommodating cavity is configured to accommodate the first assembly therein; and after the triggering subassembly is triggered, the unfolding subassembly is unfolded to open the accommodating cavity, and meanwhile the ejection subassembly ejects the first assembly out of the accommodating cavity.

The child-mother toy according to the present disclosure can realize separation of the child assembly and the mother assembly, has a simple structure, a high entertainment, high action reliability, low cost, and is suitable for batch production.

In some embodiments, the ejection subassembly includes: an ejection member disposed to the supporting member and movable between an ejected position and a retracted position; and a locking member disposed to the supporting member and movable between a locked position and an unlocked position. When the locking member is located in the locked position, the ejection member is locked in the retracted position by means of the locking member, and when the locking member moves to the unlocked position, the ejection member is released by means of the locking member so as to enable the ejection member to be ejected.

In some embodiments, the ejection member is movable forward and backward between the ejected position and the retracted position by means of a first driving member, and the locking member is movable leftwards and rightwards between the locked position and the unlocked position by means of a second driving member.

In some embodiments, a side wall of the ejection member in a left-and-right direction is provided with two limit blocks spaced apart in a front-and-rear direction, and a limit groove is defined between the two limit blocks, the locking member includes an annular portion having an axis extending in the front-and-rear direction so that the annular portion is fitted over the ejection member. When the locking member is located in the locked position, a side arm of the annular portion in the left-and-right direction is fitted into the limit groove, and when the locking member moves to the unlocked position, the side arm moves out of the limit groove to be released.

In some embodiments, an outer side surface of a rearward limit block of the two limit blocks is configured as a guiding surface extending obliquely towards a longitudinal center line of the ejection member from front to rear, and during a movement of the ejection member from the ejected position to the retracted position from the front to the rear, the guiding surface guides the side arm into the limit groove.

In some embodiments, a side surface of the supporting member in the left-and-right direction has a notch, the locking member includes an extending portion connected with the annular portion and capable of extending out of the supporting member through the notch, the unfolding subassembly includes a triggering block, and during unfolding of the unfolding subassembly, the triggering block pushes the extending portion to move towards an interior of the supporting member along the notch, and the extending portion drives the side arm to move outwards from the limit groove.

In some embodiments, the unfolding subassembly includes two unfolding casings pivotably connected to a left side edge and a right side edge of the supporting member separately. When the two unfolding casings are pivoted towards a top of the supporting member and in a direction of approaching each other, they are folded, and when the two unfolding casings are pivoted away from each other, they are unfolded.

In some embodiments, a third driving member is provided where each unfolding casing and the supporting member are pivotably jointed, and the third driving member applies force to the unfolding casing so as to enable the unfolding casing to tend to be unfolded.

In some embodiments, a bouncing rod is disposed at an inner side of each unfolding casing, an end of the bouncing rod is pivotably connected to the corresponding unfolding casing, a fourth driving member is disposed between the bouncing rod and an inner surface of the unfolding casing, and the fourth driving member applies force to another end of the bouncing rod in a direction away from the corresponding unfolding casing so as to enable the corresponding unfolding casing to tend to be unfolded.

In some embodiments, the unfolding subassembly includes a hook member having a hook groove opened at a rear side, the triggering subassembly includes: a stop block having a stop hole penetrating the stop block along an up-and-down direction; and a stop rod passing through the stop hole from bottom to top. When the stop rod moves to a front limit position of the stop hole, the stop rod is fitted into the hook groove so as to lock the unfolding subassembly in a folded state, and when the limit rod moves backwards along the stop hole, the stop rod moves backwards out of the hook groove so as to release the unfolding subassembly to enable the unfolding subassembly to be unfolded.

In some embodiments, the triggering subassembly includes a triggering arm unit, a first layer triggering unit and a second layer triggering unit, the triggering arm unit is disposed to a left side and/or a right side of the supporting member, and the first layer triggering unit is disposed to an upper side and/or a lower side of the second layer triggering unit, when the first layer triggering unit is triggered, the first layer triggering unit triggers the triggering arm unit to perform arm unfolding, and during the arm unfolding of the triggering arm unit, the second layer triggering unit is triggered to act to unfold the unfolding subassembly.

In some embodiments, the triggering arm unit includes two triggering arms, and the two triggering arms are disposed to the left side and the right side of the supporting member separately and have an end pivotably connected to the supporting member respectively.

In some embodiments, the triggering arm is provided with an arm side holding opening, and the triggering arm is provided with a magnetic attraction member therein so as to enable a magnetic body to be held at the arm side holding opening.

In some embodiments, the first layer triggering unit includes: a first layer magnetic attraction member fixed to the supporting member; a first layer front moving member disposed to the supporting member and movable forwards and backwards; and a first layer rear moving member disposed to the supporting member and movable forwards and backwards, and located at a rear side of the first layer front moving member. When a left side and a right side of the first layer rear moving member are separately provided with an arm locking member configured to lock the triggering subassembly in an arm folded state; when the first layer magnetic attraction member attracts a magnetic body to push the first layer front moving member to move backwards, the first layer front moving member pushes the first layer rear moving member to move backwards; and during backward movement of the first layer rear moving member, the triggering arm unit is released to enable the triggering arm unit to perform the arm unfolding.

In some embodiments, the second layer triggering unit includes: a second layer front moving member disposed to the supporting member and movable forwards and backwards, a left side and a right side of a front end of the second layer front moving member being provided with a touching block separately; a second layer rear moving member disposed to the supporting member and movable forwards and backwards, and located at a rear side of the second layer front moving member. The second layer rear moving member is provided with a stop rod configured to lock the unfolding subassembly in a folded state; during the arm unfolding of the triggering arm unit, the triggering arm unit pushes the touching block backwards so as to make the second layer front moving member move backwards; and during the backward movement of the second layer front moving member, the second layer rear moving member is pushed to move backwards so as to make the stop rod release the unfolding subassembly and enable the unfolding subassembly to be unfolded.

In some embodiments, the first assembly includes a fixed member, a triggering component, an unfolding component and an overturning component; the triggering component, the unfolding component and the overturning component are disposed to the fixed member; the unfolding component is unfolded when the triggering component is triggered; the overturning component is driven to pivot during unfolding of the unfolding component, and the first assembly is driven to turn over in the air during pivoting of the overturning component.

The additional aspects and advantages of the present disclosure will be set forth in part in the following description, which will become apparent from the following description or be learned by the practice of the present disclosure.

Figure 1:
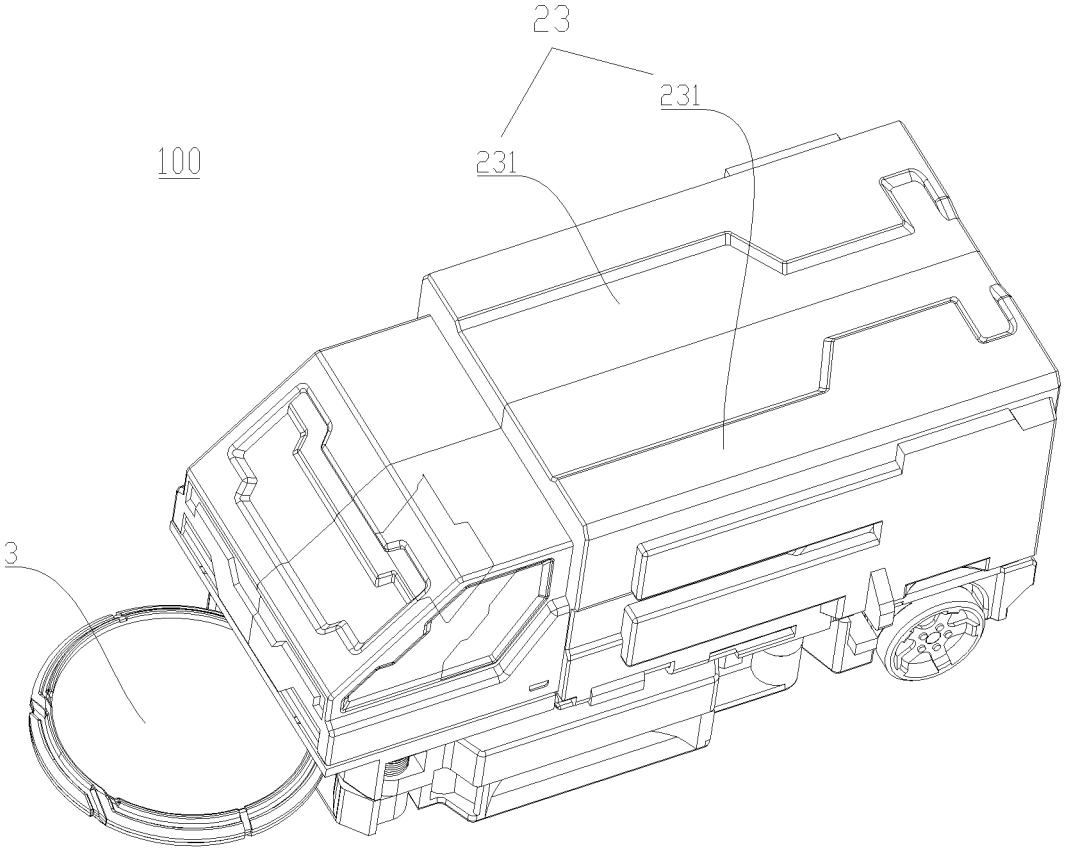
FIG. 1 is a perspective view of a child-mother toy according to embodiments of the present disclosure in an angle.

REFERENCE NUMERALS child-mother toy 100;
first assembly 1;
fixed member 11;
triggering component 12; magnet 121; moving block 122; hook 1221;
unfolding component 13; hook groove 131;
overturning component 14; hook locking hole 141;
hook component 15;
second assembly 2;
supporting member 21; notch 210;
triggering subassembly 22; stop block 221; stop hole 2210; stop rod 222;

triggering arm unit 223; arm side holding opening 2230; triggering arm 2231; locking opening 22310; poke block 22311;

fifth driving member 2232; arm side magnetic attraction member 2233;

first layer triggering unit 224; first layer magnetic attraction member 2241; first layer front moving member 2242;

first layer rear moving member 2243; arm locking member 22430;

second layer triggering unit 225; second layer front moving member 2251; touching block 22510;

second layer rear moving member 2252;

unfolding subassembly 23; triggering block 230; unfolding casing 231; pivoting shaft 232; third driving member 233;

bouncing rod 234; embedding groove 2340; fourth driving member 235;

hook member 236; hook groove 2360;

ejection subassembly 24; ejection member 241; limit block 2411; guiding surface 24110; limit groove 2412;

locking member 242; annular portion 2421; side arm 24210; extending portion 2422;

first driving member 243; second driving member 244;

magnetic coin 3.

DETAILED DESCRIPTION

The embodiments of the present disclosure are described in detail below, and the examples of the embodiments are illustrated in the drawings, wherein the same or similar reference numerals are used to refer to the same or similar elements or elements having the same or similar functions. The embodiments described below with reference to the drawings are intended to be illustrative of the disclosure and are not to be construed as limiting.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied. Moreover, a structure in which a first feature is "on" a second feature may include an embodiment in which the first feature directly contacts the second feature, and may also include an embodiment in which an additional feature is formed between the first feature and the second feature so that the first feature does not directly contact the second feature.

A child-mother toy 100 according to embodiments of the present disclosure is described in detail with reference to the accompanying drawings.

As illustrated in FIG. 1, FIG. 2, FIG. 10, and FIG. 17, the child-mother toy 100 according to embodiments of the present disclosure includes a first assembly 1 (i.e. a child assembly) and a second assembly 2 (i.e. a mother assembly). The first assembly 1 and the second assembly 2 can have independent configurations separately. That is, when the first assembly 1 is taken out individually, the first assembly 1 can have a complete configuration and can be used for playing, for example, the first assembly 1 can be a deformation toy vehicle, and meanwhile, when the second assembly 2 is taken out individually, the second assembly 2 can also have a complete configuration and can be used for playing, for example, the second assembly 2 can be a deformation toy vehicle.

Referring to FIG. 17 to FIG. 20, the first assembly 1 can include a fixed member 11, a triggering component 12, an unfolding component 13 and an overturning component 14, and the triggering component 12, the unfolding component 13 and the overturning component 14 are disposed to the fixed member 11. When the triggering component 12 is triggered, the unfolding component 13 is unfolded, and the overturning component 14 is driven to pivot during the unfolding of the unfolding component 13, and the first assembly 1 as a whole is driven to turn over in the air during the pivoting of the overturning component 14.

That is, when the triggering component 12 is triggered, the first assembly 1 can perform two actions including unfolding and deformation, and turning-over in the air. For example, the first assembly 1 can present a vehicle shape initially, and when the coin clamping action is triggered, the first assembly 1 can turn over in the air, and meanwhile be unfolded to deform to present a shape of an animal, an insect and a figure sitting on a vehicle frame. Here, it should be noted that a structure and an operation principle of the first assembly 1 capable of realizing the above-described action change are well known to those skilled in the art, and are only briefly described below, and are not repeated herein.

Referring to FIG. 1 to FIG. 16, the second assembly 2 includes a supporting member 21 and a triggering subassembly 22, an unfolding subassembly 23 and an ejection subassembly 24, and the triggering subassembly 22, the unfolding subassembly 23 and the ejection subassembly 24 are disposed to the supporting member 21. Before the triggering subassembly 22 is triggered, the unfolding subassembly 23 is folded at the supporting member 21 so that an accommodating cavity configured to accommodate the first assembly 1 therein is defined between the unfolding subassembly 23 and the supporting member 21. After the triggering subassembly 22 is triggered, the unfolding subassembly 23 is unfolded to open the accommodating cavity, and meanwhile the ejection subassembly 24 ejects the first assembly 1 out of the accommodating cavity.

That is, before the triggering subassembly 22 is triggered, the unfolding subassembly 23 presents a folded state, in this case, the unfolding subassembly 23 in the folded state and the supporting member 21 cooperatively define the accommodating cavity, and at least a part of the first assembly 1 is accommodated in the accommodating cavity, for example, the first assembly 1 can be accommodated in the accommodating cavity in whole, and in this case, the unfolding subassembly 23 in the folded state and the supporting member 21 can cooperatively wrap the first assembly 1, that is, the second assembly 2 wraps the first assembly 1 in the second assembly 2.

After the triggering subassembly 22 is triggered, the unfolding subassembly 23 can be unfolded so as to open the accommodating cavity, and the first assembly 1 can be exposed, and meanwhile, the ejection subassembly 24 can apply an ejection force on the first assembly 1 so that the first assembly 1 subjecting to the ejection force and not constrained by the accommodating cavity can be ejected out, and further ejected the first assembly 1 can perform the above-mentioned deformation and over-turning actions. Therefore, entertainment of the child-mother toy 100 can be effectively improved.

The child-mother toy 100 according to embodiments of the present disclosure can realize the separation of the child assembly and the mother assembly, and has a simple structure, high entertainment, and high action reliability.

Figure 5:
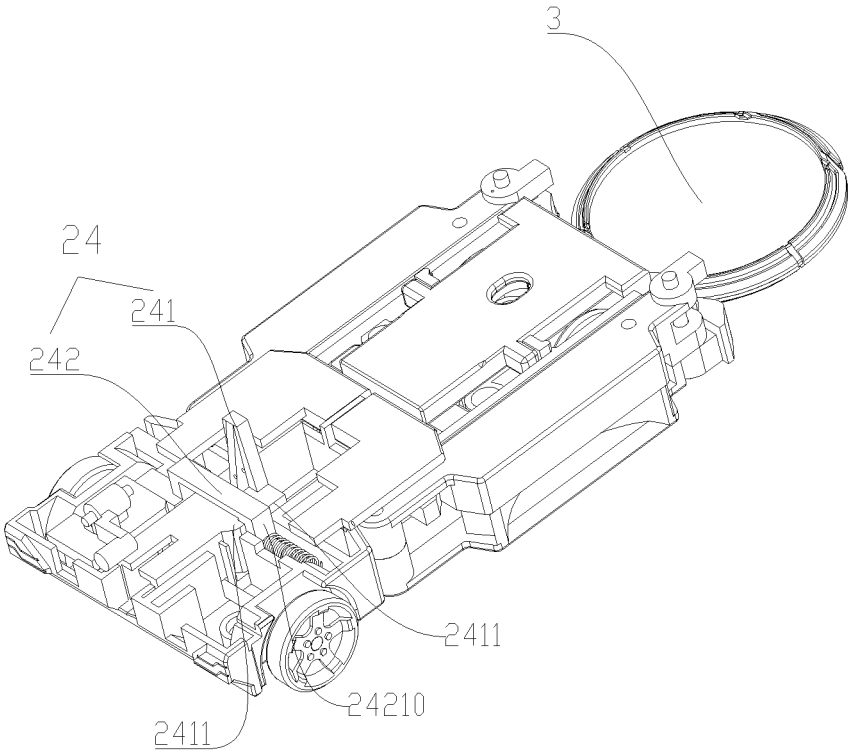
FIG. 5 is another exploded view of the second assembly illustrated in FIG. 4.
Figure 6:
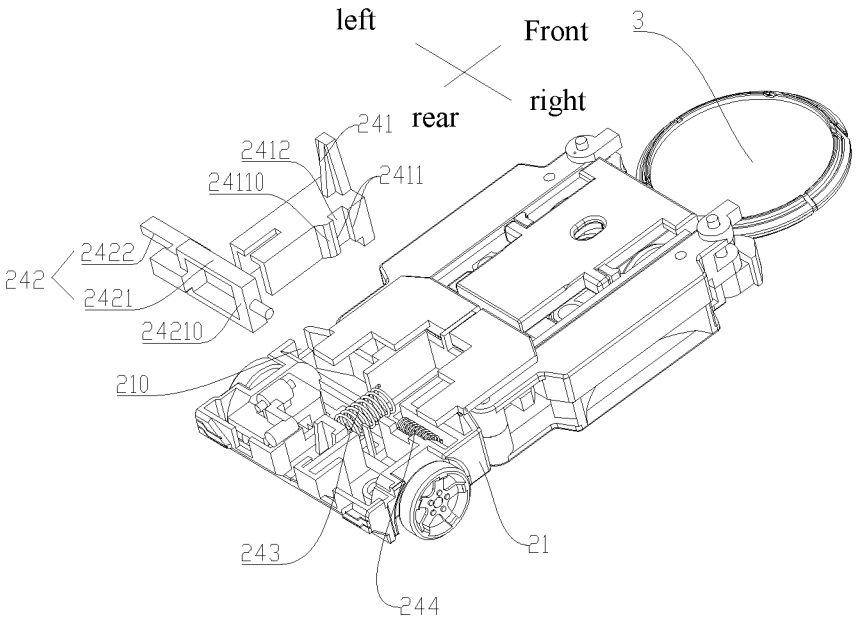
FIG. 6 is another exploded view of the second assembly illustrated in FIG. 4.

Referring to FIG. 6, the ejection subassembly 24 can include an ejection member 241 and a locking member 242. The ejection member 241 is disposed to the supporting member 21 and movable between an ejected position and a retracted position. The locking member 242 is disposed to the supporting member 21 and is movable between a locked position (referring to FIG. 4 and FIG. 5) and an unlocked position (referring to FIG. 13 and FIG. 14). When the locking member 242 is located in the locked position (referring to FIG. 4 and FIG. 5), the ejection member 241 is locked in the retracted position (referring to FIG. 4 and FIG. 5) by means of the locking member 242, and when the locking member 242 moves to the unlocked position (referring to FIG. 13 and FIG. 14), the ejection member 241 is released by means of the locking member 242 so as to eject the ejection member 241. In this way, it is possible to control that whether the first assembly 1 is ejected by the ejection member 241 by controlling the movement of the locking member 242 between the locked position and the unlocked position. Therefore, the ejection subassembly 24 has a simple structure and high reliability, and can be implemented conveniently. Certainly, the present disclosure is not limited to this, and the ejection subassembly 24 can also be a subassembly in other types, for example, the ejection subassembly 24 and the first assembly 1 have opposite magnetism, and when the first assembly 1 is released from the unfolding subassembly 23, the ejection subassembly 24 can eject the first assembly 1 through repulsive force between opposite magnetic poles.

Referring to FIG. 6, the ejection member 241 is movable forward and backward between the ejected position and the retracted position by means of a first driving member 243, that is, the ejected position and the retracted position are disposed in a front-and-rear direction, and the ejection member 241 can move in the front-and-rear direction back and forth under the action of the first driving member 243. Thus, the ejection member 241 has good ejection effect and can eject the first assembly 1 reliably. For example, in the example illustrated in FIG. 6, the ejected position is located in front of the retracted position, the first driving member 243 can be a spring and stretchable in the front-and-rear direction, a rear end of the spring can be abutted against or be fixed to the supporting member 21, and when a backward constraining force is applied to the ejection member 241, the ejection member 241 can move backwards to the retracted position, and meanwhile the ejection member 241 pushes a front end of the spring to move backwards so as to enable the spring to be compressed, in this case, the front end of the spring can apply a forward pushing force to the ejection member 241, and when the ejection member 241 is not subjected to the backward constraining force, the spring can recover the deformation so as to eject the ejection member 241 forwards. Thus, the ejection member 241 has good ejection effect. Certainly, the present disclosure is not limited to this, the first driving member 243 can also be other components, such as a magnet 121.

Referring to FIG. 6, the locking member 242 can be movable leftwards and rightwards between the locked position and the unlocked position by means of a second driving member 244, that is, the locked position and the unlocked position are arranged in a left-and-right direction and the locking member 242 can move in the left-and-right direction back and forth under the action of the second driving member 244. Thus, the locking member 242 has a good locking and unlocking effect and can lock the ejection member 241 and unlock the ejection member 241 reliably. For example, in the example illustrated in FIG. 6, the unlocked position is located at a right side of the locked position, the second driving member 244 can be a spring and stretchable in the left-and-right direction, a right end of the spring can be abutted against or fixed to 21, and when a rightward constraining force is applied to the locking member 242, the locking member 242 can move rightwards to the unlocked position while pushing a left end of the spring to move rightwards to enable the spring to be compressed, in this case, the left end of the spring can apply leftward pushing force to the ejection member 241; when the locking member 242 is not subjected to the rightward constraining force, the spring can recover the deformation to push the locking member 242 to move leftwards to the locked position. Thus, the ejection member 241 has good ejection effect. Certainly, the present disclosure is not limited to this, the second driving member 244 can also be other components, such as the magnet 1 the supporting member 21.

Figure 14:
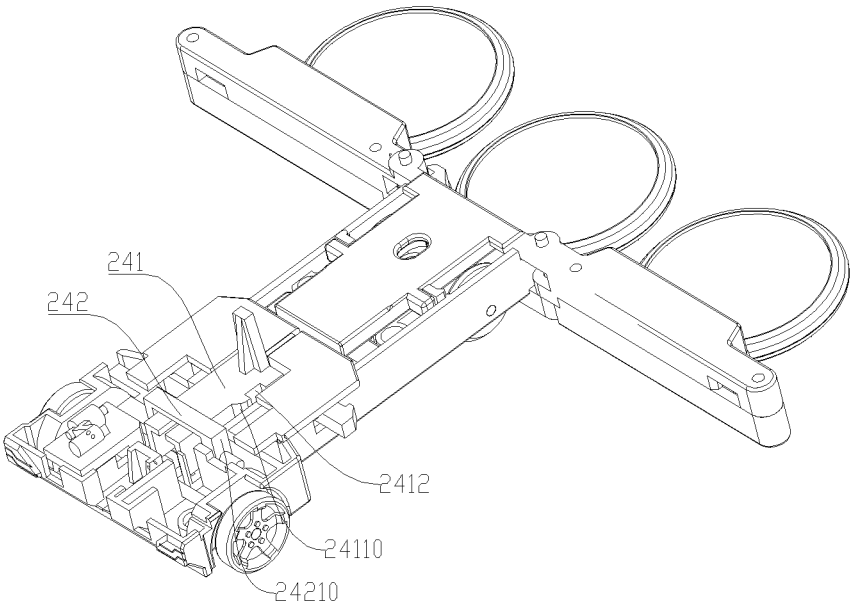
FIG. 14 is another exploded view of the second assembly illustrated in FIG. 4.

Referring to FIG. 6, a side wall of the ejection member 241 in the left-and-right direction is provided with two limit blocks 2411 spaced apart in the front-and-rear direction, a limit groove 2412 is defined between the two limit blocks 2411, and the locking member 242 includes an annular portion 2421, and an axis of the annular portion 2421 extends in the front-and-rear direction so as to be fitted over the ejection member 241, that is, the ejection member 241 can pass through an inner ring hole defined by the annular portion 2421 in the front-and-rear direction, as illustrated in FIG. 5, when the locking member 242 is located in the locked position, a side arm 24210 of the annular portion 2421 in the left-and-right direction is fitted into the annular portion 2421, as illustrated in FIG. 14. When the locking member 242 moves to the unlocked position, the side arm 24210 moves out of the limit groove 2412 to realize the releasing. Thus, the method of locking and unlocking is simple and can be realized reliably and stably. Furthermore, as the annular portion 2421 is fitted over the ejection member 241, it is possible to prevent a problem of locking failure resulted by separation of the locking member 242 and the ejection member 241. Certainly, the present disclosure is not limited to this, besides relying on the cooperation between the limit groove 2412 and the side arm 24210, the locking and unlocking can also be realized by other structures such as by the operation between a pushing rod and a inserting hole.

Referring to FIG. 14 and FIG. 6, an outer side surface of the limit block 2411 of the two limit blocks 2411 located at the rear side is configured as a guiding surface 24110 extending obliquely towards a longitudinal center line (a line at a central position of the supporting member 21 in the left-and-right direction and extending in the front-and-rear direction) of the ejection member 241 from the front to the rear, and during the movement of the ejection member 241 from the ejected position to the retracted position from the front to the rear, the guiding surface 24110 guides the side arm 24210 into the limit groove 2412. Thus, by providing the guiding surface 24110, when pushing the ejection member 241 to move towards the folded position i.e. to move backwards, the guiding surface 24110 can push the locking member 242 to slide into the limit groove 2412 so as to move to the locked position, so that the child-mother toy 100 can be restored easily, hence to be played again conveniently and rapidly. Certainly, the present disclosure is not limited to this, the limit block 2411 may not be provided with the guiding surface 24110, as long as the locking member 242 is pushed to move rightwards manually during the retraction of the ejection member 241.

Figure 3:
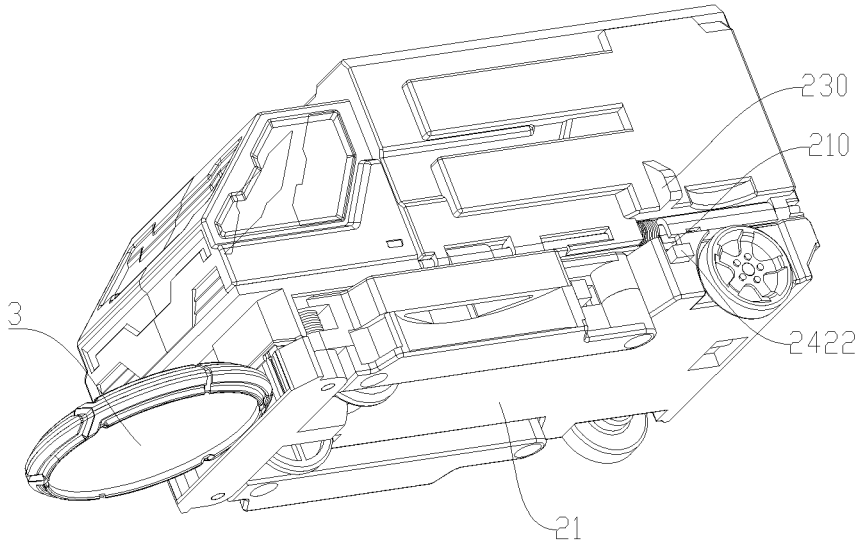
FIG. 3 is a perspective view of the chill-mother toy illustrated in FIG. 1 in another angle.
Figure 4:
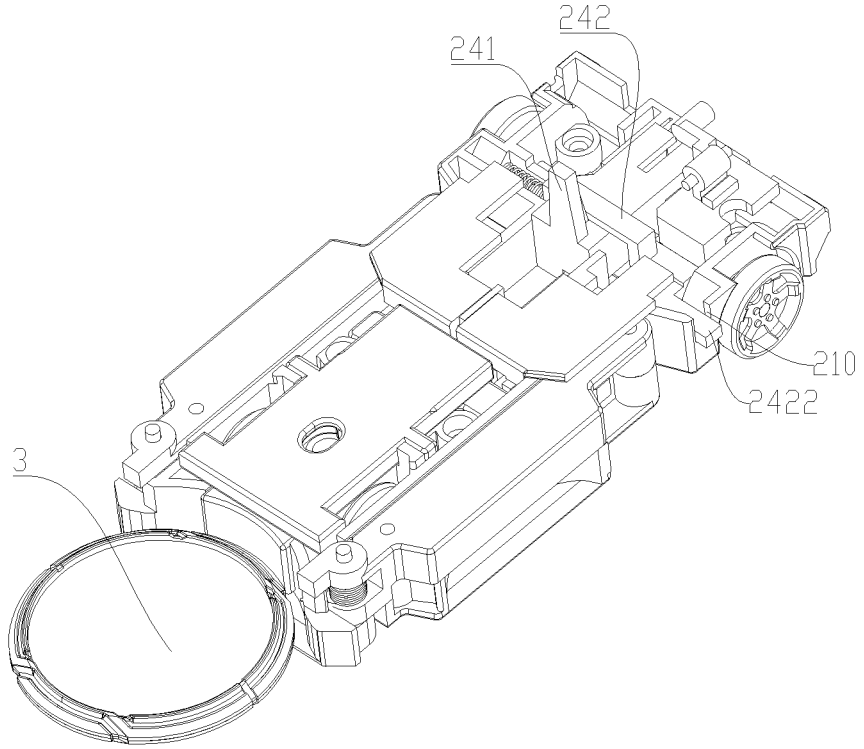
FIG. 4 is an exploded view of a second assembly illustrated in FIG. 1.

Referring to FIG. 3, FIG. 4 and FIG. 6, a side surface of the supporting member 21 in the left-and-right direction has a notch 210, and the locking member 242 includes an extending portion 2422 connected with the annular portion 2421 and capable of extending out of the supporting member 21 through the notch 210. The unfolding subassembly 23 includes a triggering block 230, referring to FIG. 12, FIG. 13 and FIG. 14, during the unfolding of the unfolding subassembly 23, the triggering block 230 pushes the extending portion 2422 to move towards an interior of the supporting member 21 along the notch 210, and the extending portion 2422 drives the side arm 24210 to move outwards from the limit groove 2412. Thus, the method of triggering the locking member 242 to unlock is simple, and can be realized reliably. Certainly, the present disclosure is not limited to this, it is possible to trigger the locking member 242 to unlock by other structural components, for example, magnets 121 of opposite magnetism can be disposed to the unfolding subassembly 23 and the locking member 242 separately, and when the unfolding subassembly 23 is unfolded to get close to the locking member 242, the locking member 242 can move to the unlocked position through the repulsive force between the magnets 121.

Figure 2:
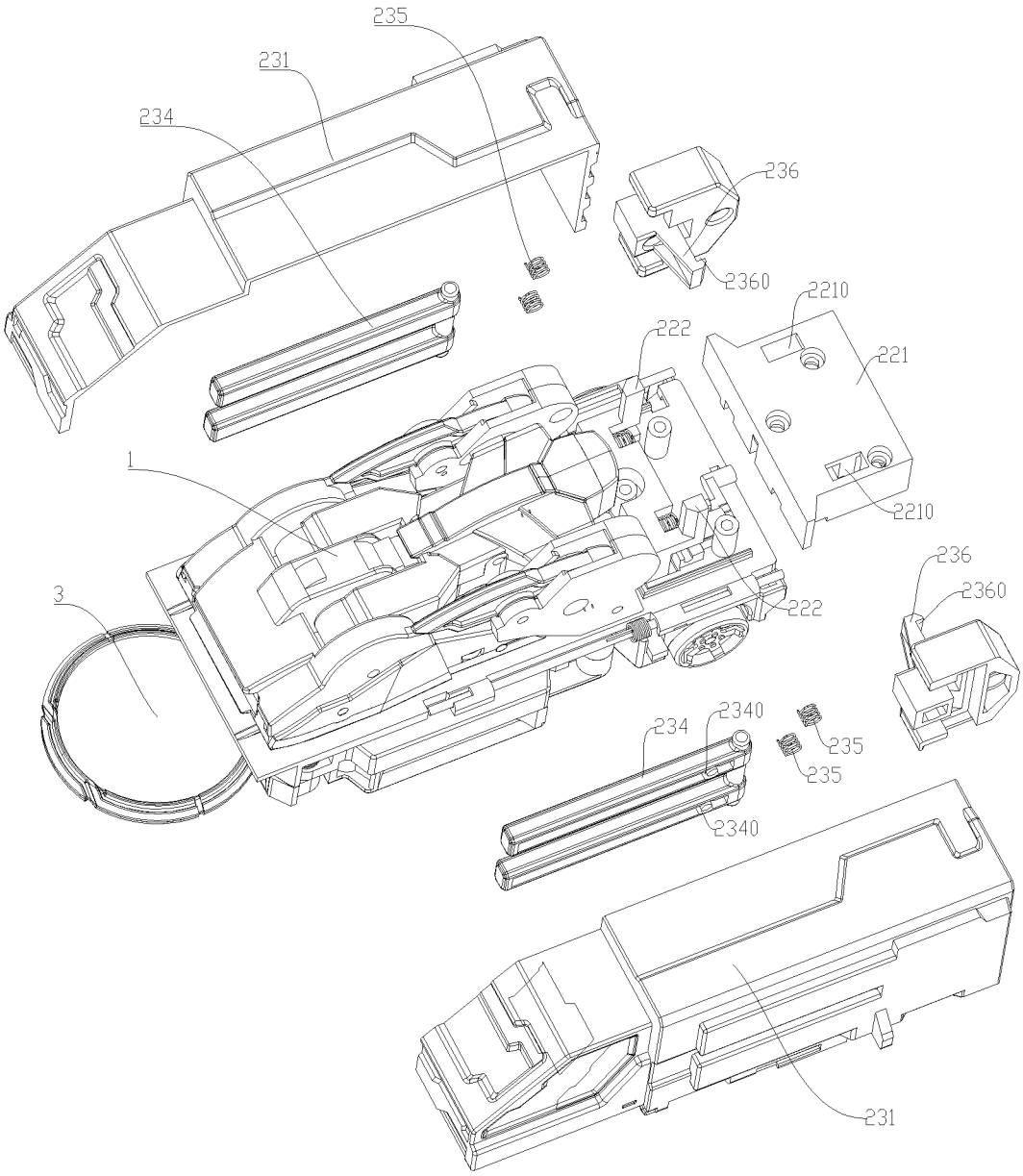
FIG. 2 is an exploded view of the child-mother toy illustrated in FIG. 1.
Figure 10:
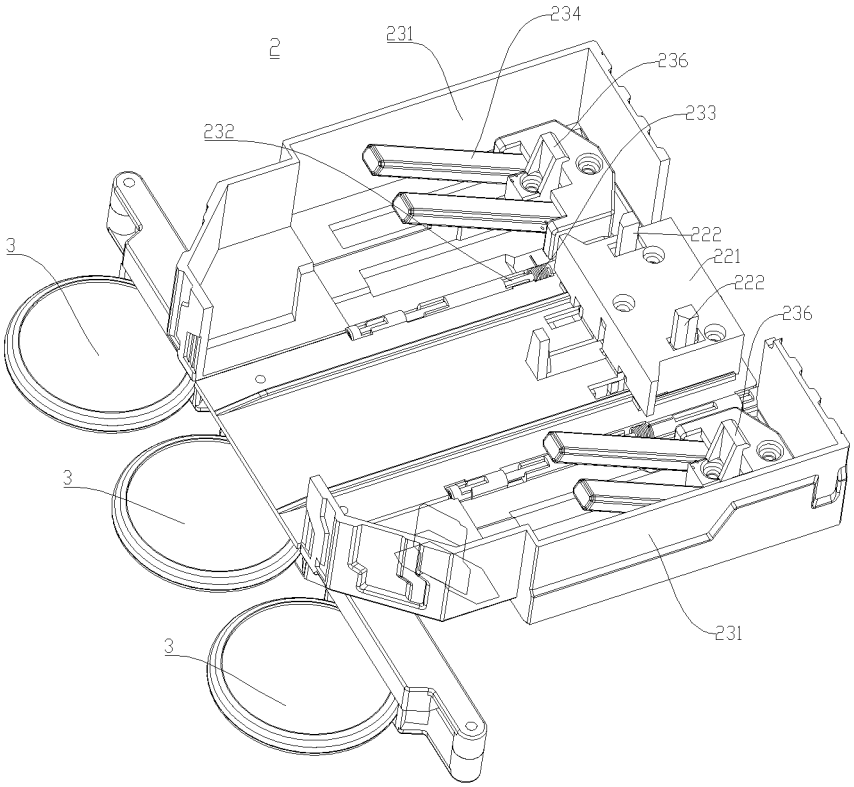
FIG. 10 is a perspective view of the deformed second assembly illustrated in FIG. 4.

Referring to FIG. 1, FIG. 2 and FIG. 10, the unfolding subassembly 23 includes two unfolded casings 231, and the two unfolded casings 231 are pivotably connected to a left side edge and a right side edge of the supporting member 21, such as a left side bottom edge and a right side bottom edge of the supporting member 21, separately. When the two unfolding casings 231 are pivoted above the supporting member 21 and towards a direction of each other separately, the folding is realized (as illustrated in FIG. 1), and when the two unfolding casings 231 are pivoted away from each other separately, the unfolding is realized (as illustrated in FIG. 10). Thus, the unfolding subassembly 23 has a simple structure and is easy to process and assembly, and can realize unfolding and folding actions easily and reliably.

Preferably, the structures of the two unfolding casings 231 can be completely identical and symmetrical in the left-and-right direction. When the two unfolding casings 231 are located in the folding position, the two unfolding casings 231 and the supporting member 21 can cooperatively form a vehicle shaped shell, in this case, the supporting member 21 can be in a chassis shape and the two unfolding casings 231 can be in the shape of a half vehicle body divided equally in the left-and-right direction separately. Certainly, the present disclosure is not limited to this, and the structures of the unfolding casing 231 can be configured specifically according to actual requirements so as to satisfy the actual requirements better.

Figure 11:
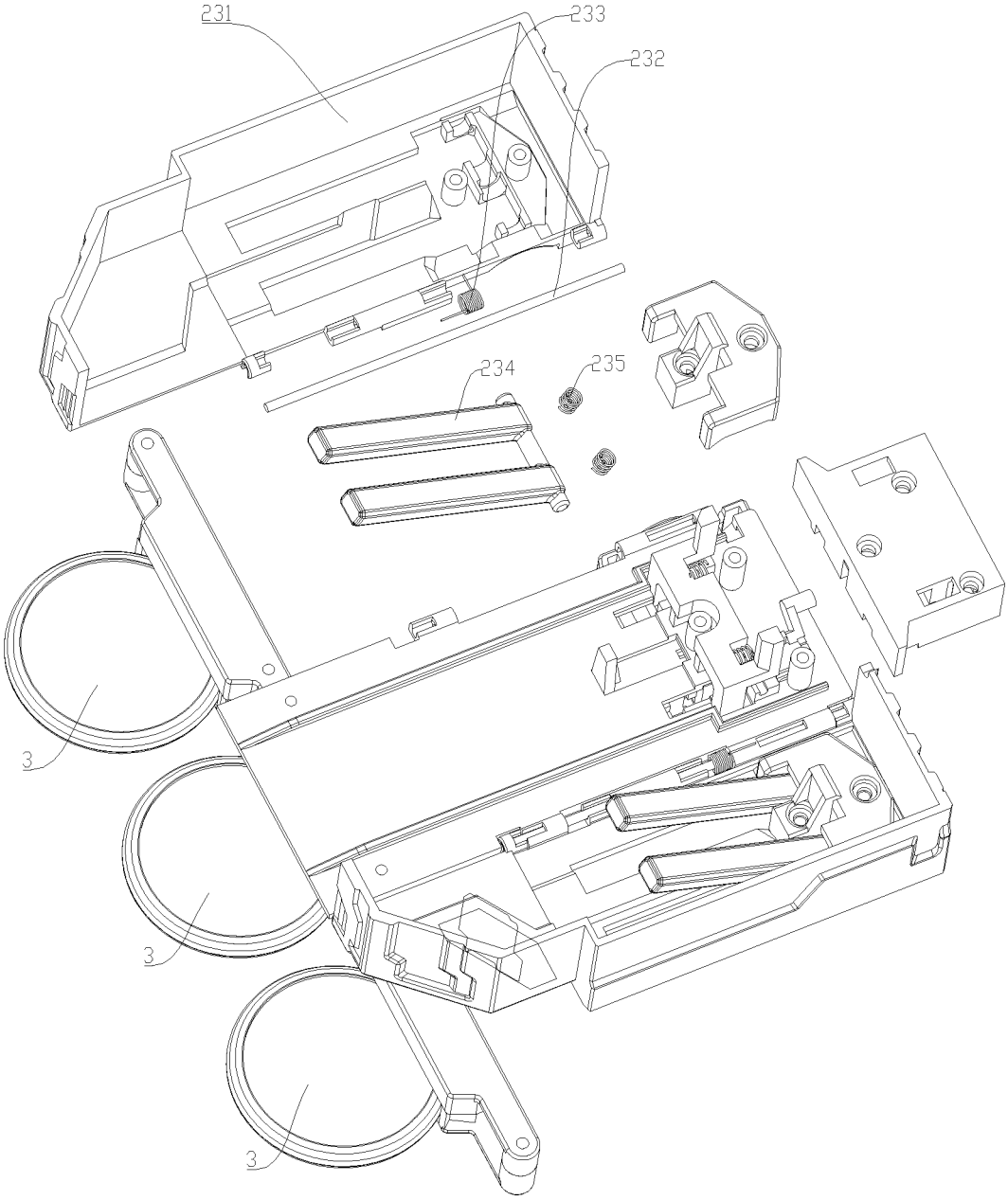
FIG. 11 is an exploded view of the second assembly illustrated in FIG. 4.
Figure 12:
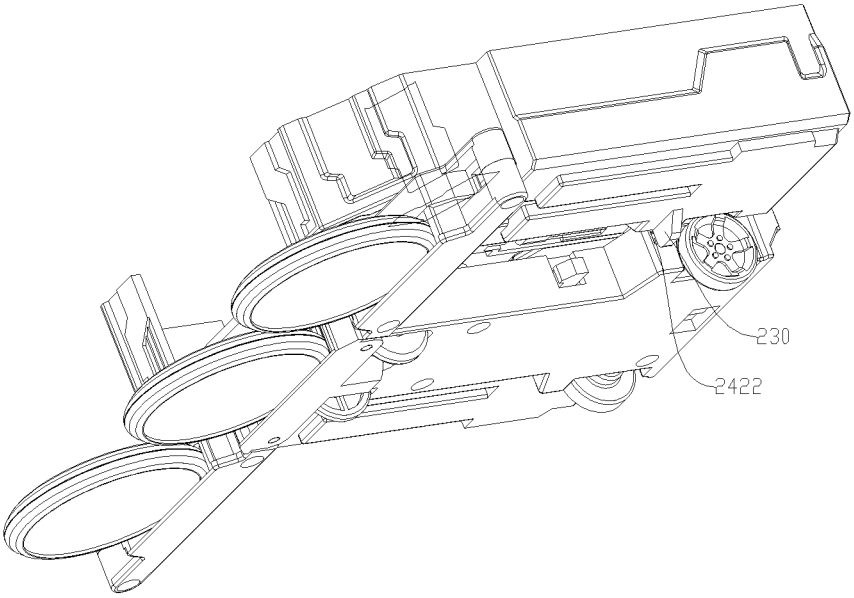
FIG. 12 is another perspective view of the second assembly illustrated in FIG. 4 after deformation.
Figure 13:
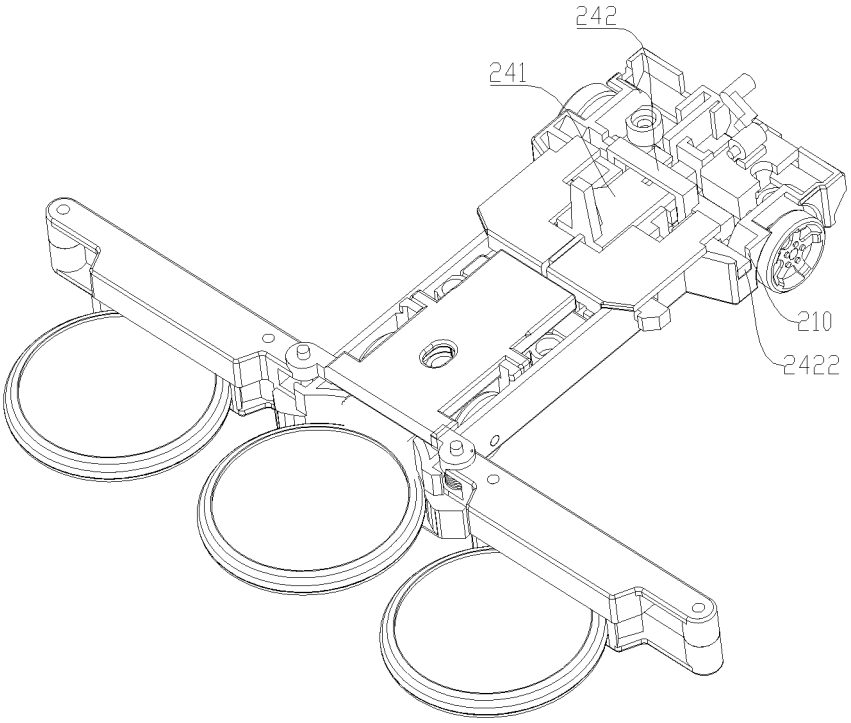
FIG. 13 is another exploded view of the second assembly illustrated in FIG. 4.

Referring to FIG. 10 and FIG. 11, each unfolding casing 231 can be pivotably connected to the supporting member 21 through a pivoting shaft 232 extending in the front-to-rear direction and a pivoting joint can be provided with a third driving member 233 applying force to the unfolding casing 231 so as to enable the unfolding casing 231 an unfolding trend, for example, the third driving member 233 can be a torsion spring fitted over the pivoting shaft 232. Thus, when not subjected to the constraining force, the unfolding casing 231 can be unfolded automatically and reliably by means of the third driving member 233, and the action can be realized with high reliability and the driving method of the unfolding is simple.

In addition, the unfolding subassembly 23 can be unfolded in other methods or in cooperation with other methods. For example, in the examples illustrated in FIG. 2, FIG. 10 and FIG. 11, a bouncing rod 234 is disposed at an inner side of each the unfolding casing 231, one end of the bouncing rod 234 is pivotably connected to respective unfolding casing 231, a fourth driving member 235 is disposed between the bouncing rod 234 and an inner surface of the unfolding casing 231, and the fourth driving member 235 applies force in a direction away from the respective unfolding casing 231 to the other end of the bouncing rod 234 so as to enable the respective unfolding casing 231 to have an unfolding trend through a reaction force of the bouncing rod 234.

For example, in the examples illustrated in FIG. 2, a side surface at a rear end of the bouncing rod 234 facing the unfolding casing 231 has an embedding groove 2340, the fourth driving member 235 can be the spring and extend into the embedding groove 2340 so as to make the bouncing rod 234 and the unfolding casing 231 located at two ends of the spring to move away from each other. The bouncing rod 234 cannot move due to the blocking by the components in the supporting member 21 such as the first assembly 1, so the unfolding casing 231 can move in a direction away from the bouncing rod 234 to realize the unfolding under the action of the spring force. Thus, the unfolding of the unfolding subassembly 23 can be controlled by simple mechanical structures, which reduces the manufacturing cost and ensures the reliability of action implementation. Certainly, the present disclosure is not limited to this, and the unfolding of the unfolding subassembly 23 can be controlled by other methods, for example, the unfolding of the unfolding subassembly 23 can be realized by the repulsive force between magnets of opposite magnetism.

Referring to FIG. 2, the unfolding subassembly 23 includes a hook member 236 having a hook groove 2360 which is open at a rear side. The triggering subassembly 22 includes a stop block 221 and a stop rod 222. The stop block 221 has a stop hole 2210 penetrating the stop block 221 along an up-and-down direction; and the stop rod 222 passes through the stop hole 2210 from bottom to top. When the stop rod 222 moves to a front limit position of the stop hole 2210, the stop rod 222 is fitted into the hook groove 2360 so as to lock the unfolding subassembly 23 in a folded state (referring to FIG. 2), and when the stop rod 222 moves backwards along the stop hole 2210, the stop rod 222 moves backwards out of the hook groove 2360 so as to release the unfolding subassembly 23 to enable the unfolding subassembly 23 to be unfolded (referring to FIG. 10). That is, when the stop rod 222 moves backwards, the stop rod 222 can move out of the hook groove 2360 from an opened side of the hook groove 2360, so as to release the constraint on the hook member 236 and enable the unfolding subassembly 23 to be unfolded.

Thus, the triggering subassembly 22 can trigger the unfolding subassembly 23 to be unfolded simply and reliably, with is highly reliable and easy to implement. In addition, with operation of the stop rod 222 and the stop block 221, excessive movement of the stop rod 222 can be effectively prevented, the hook member 236 can be prevented from being damaged, and the stop rod 222 can be ensured to be reliably fitted with the hook member 236 again. Certainly, the present disclosure is not limited to this, in other embodiments of the present disclosure, the unfolding subassembly 23 can be controlled to unfold in other ways, for example, the triggering subassembly 22 can include a moving magnet, and the unfolding subassembly 23 can have a magnet having same magnetism with the magnet of the triggering subassembly 22. When the magnet in the triggering subassembly 22 moves away, the magnet in the triggering subassembly 22 and the unfolding magnet are no longer attracted and constrained by each other. In this way, under the action of the third driving member 233 and the fourth driving member 235, the unfolding subassembly 23 can be smoothly unfolded.

Figure 7:
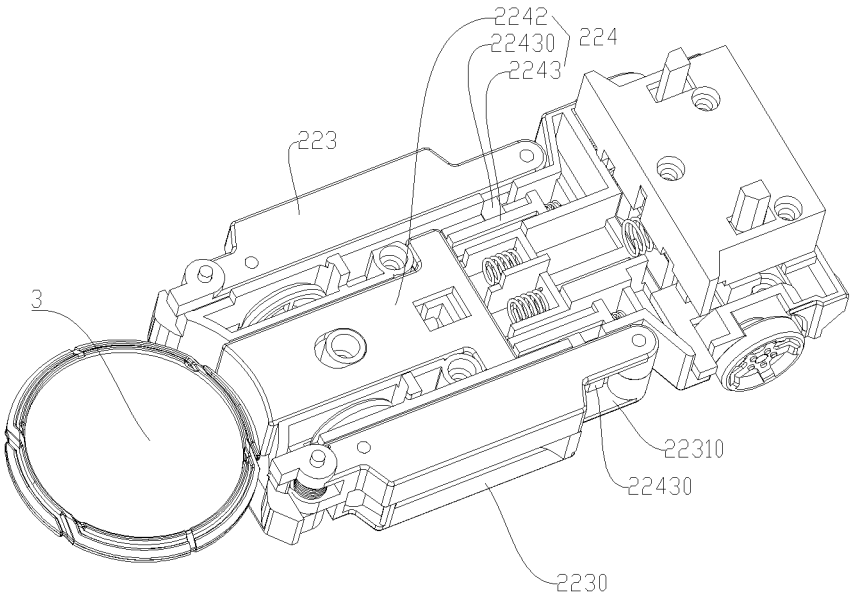
FIG. 7 is another exploded view of the second assembly illustrated in FIG. 4.
Figure 15:
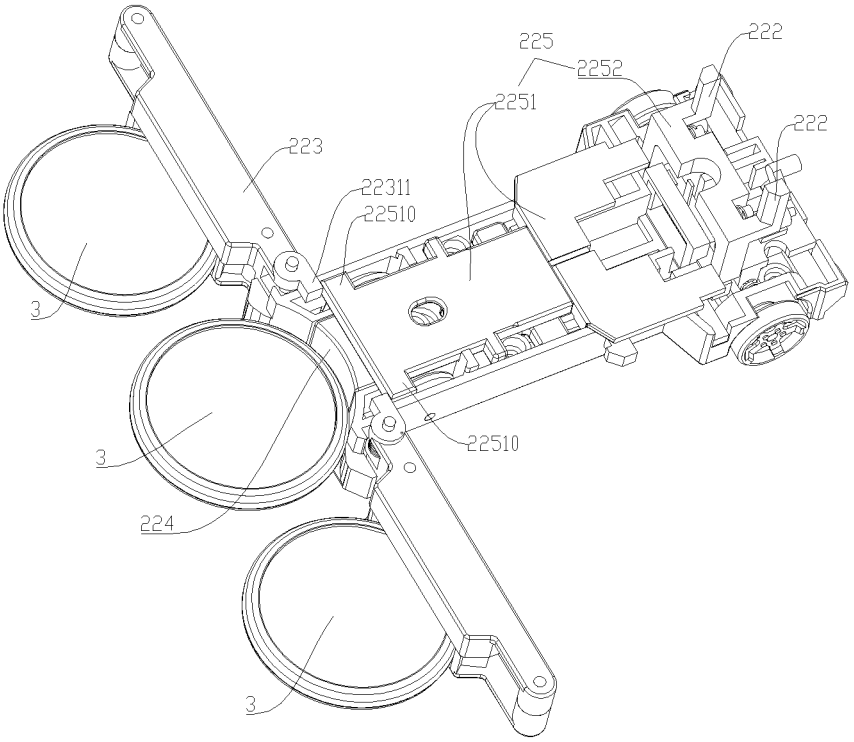
FIG. 15 is another exploded view of the second assembly illustrated in FIG. 4.

In some embodiments of the present disclosure, referring to FIG. 7 and FIG. 15, the triggering subassembly 22 includes a triggering arm unit 223, a first layer triggering unit 224 and a second layer triggering unit 225. The triggering arm unit 223 can be disposed to a left side or a right side of the supporting member 21, or be disposed to both of the left side and the right side of the supporting member 21, and the first layer triggering unit 224 can be disposed to an upper side or a lower side of the second layer triggering unit 225, or be disposed to both of the upper side and the lower side of the second layer triggering unit 225. When the first layer triggering unit 224 is triggered, the first layer triggering unit 224 drives the triggering arm unit 223 to present an arm unfolding state (as illustrated in FIG. 15), and when the triggering arm unit 223 presents the arm unfolding state, the triggering arm unit 223 triggers the second layer triggering unit 225 to drive the unfolding subassembly 23 to unfold (as illustrated in FIG. 10). Thus, with a series of mechanical actions, the unfolding of the unfolding subassembly 23 can be effectively controlled, the control method is simple, and the controlling mechanism is simple, low in cost and has low fault rate. Certainly, the present disclosure is not limited to this, in other embodiments of the present disclosure, the unfolding of the unfolding subassembly 23 can also be controlled by means of a motor, an electronic control, communication, or the like. Hereinafter, the case where the triggering arm unit 223 is disposed to the left side and the right side of the supporting member 21 and the first layer triggering unit 224 is disposed at the lower side of the second layer triggering unit 225 is taken as an example. Certainly, it is obvious that those skilled in the art can understand other variants when they have read the technical solution in the following.

Figure 16:
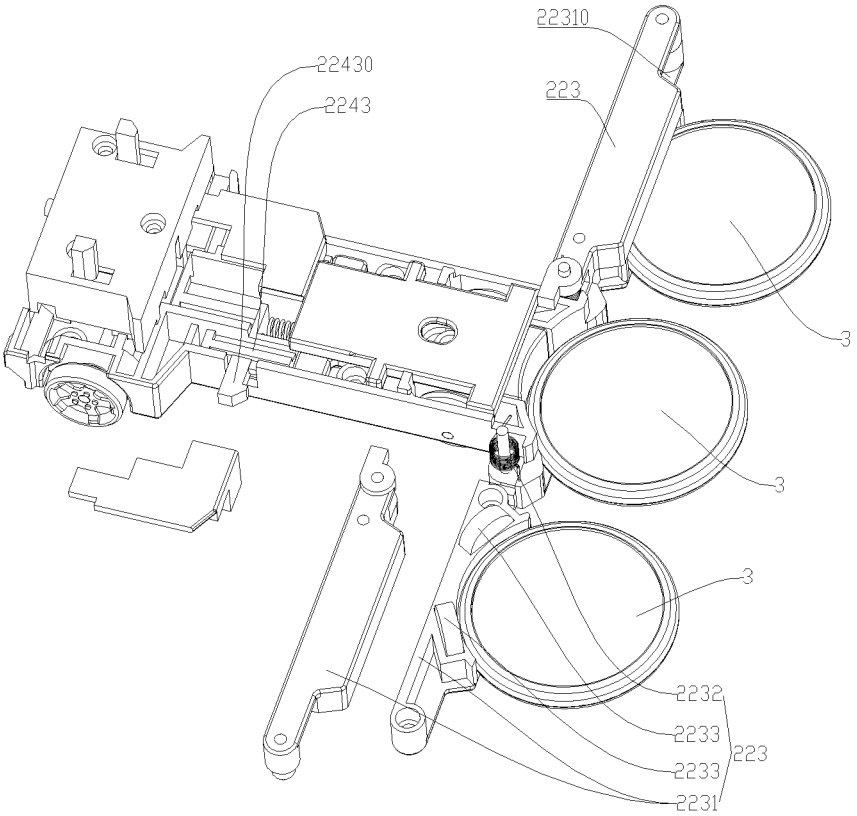
FIG. 16 is another exploded view of the second assembly illustrated in FIG. 4.
Figure 17:
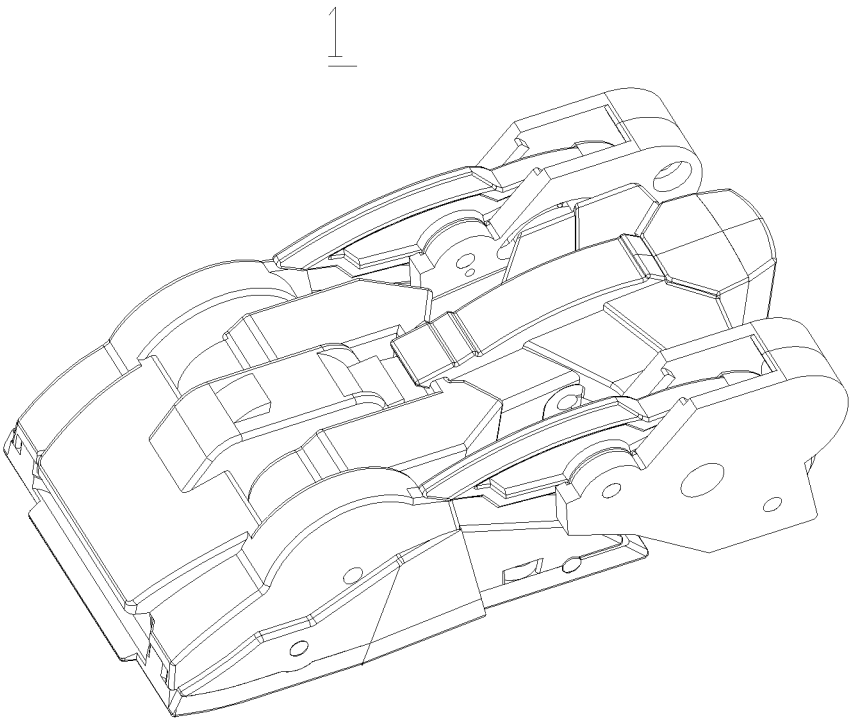
FIG. 17 is a perspective view of a first assembly illustrated in FIG. 1 before deformation.

Referring to FIG. 15 and FIG. 16, the triggering arm unit 223 includes two triggering arms 2231, and the two triggering arms 2231 are disposed to the left side and the right side of the supporting member 21 separately and have an end pivotably connected to the supporting member 21 respectively. For example, in the examples illustrated in FIG. 16, a front end (the front end in the arm folded state) of each triggering arm 2231 is pivotably connected to the supporting member 21 so as to make a rear end (the rear end in the arm folded state) of each triggering arm 2231 be pivotable in a horizontal plane. Thus, when the triggering arm unit 223 includes two triggering arms 2231 including a left triggering arm 2231 and a right triggering arm 2231, when the triggering arm unit 223 performs the arm unfolding action, the supporting member 21 can still move stably so as to ensure entertainment performance of the child-mother toy 100 to be properly performed.

Preferably, when the triggering arm 2231 performs the arm folded state (as illustrated in FIG. 7), the front end and the rear end of each triggering arm 2231 is attached to a side wall of the supporting member 21; and when the triggering arm unit 223 perform the arm unfolded state (as illustrated in FIG. 16), the rear end of each triggering arm 2231 can pivot forwards to be flush with the front end of the triggering arm 2231. Preferably, a fifth driving member 2232 such as a torsion spring can be fitted over a pivoting connection shaft of the triggering arm 2231 and the supporting member 21. When the rear end of the triggering arm 2231 is not subject to the constraining force, the torsion spring can drive the rear end of the triggering arm 2231 to pivot forward. Further, referring to FIG. 7, the triggering arm 2231 can also be provided with an arm side holding opening 2230, the triggering arm 2231 is provided with an arm side magnetic attraction member 2233 therein so as to enable a magnetic attraction element such as a magnetic coin 3 illustrated in FIG. 16 to be held at the arm side holding opening 2230. Thus, the entertainment of the child-mother toy 100 can be improved, for example, when the triggering arm 2231 presents the arm unfolded state, the magnetic coin 3 at neighborhood can be attracted and held by means of magnetic force.

Figure 8:
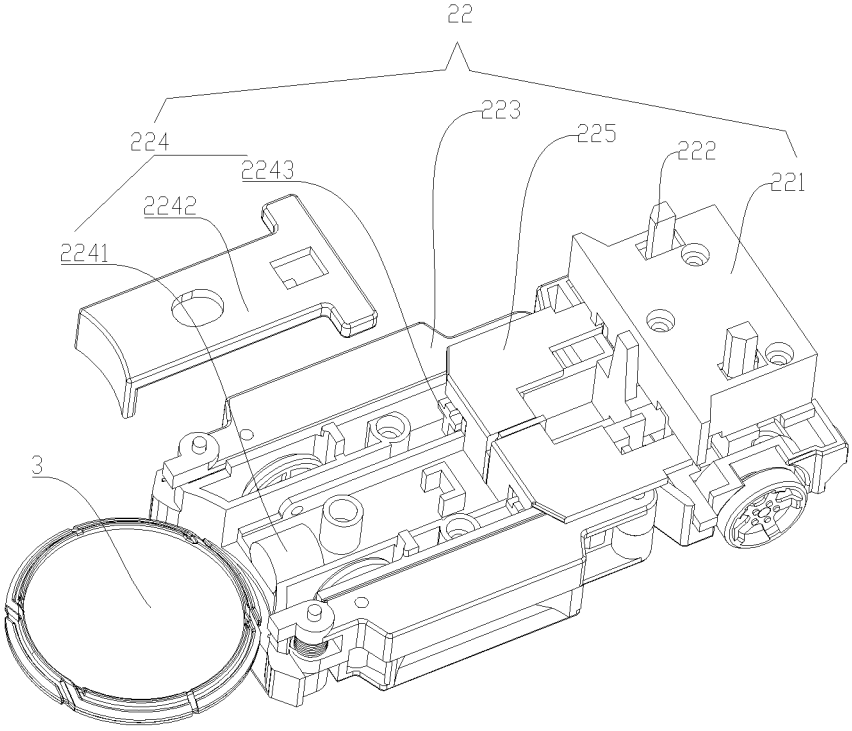
FIG. 8 is another exploded view of the second assembly illustrated in FIG. 4.
Figure 9:
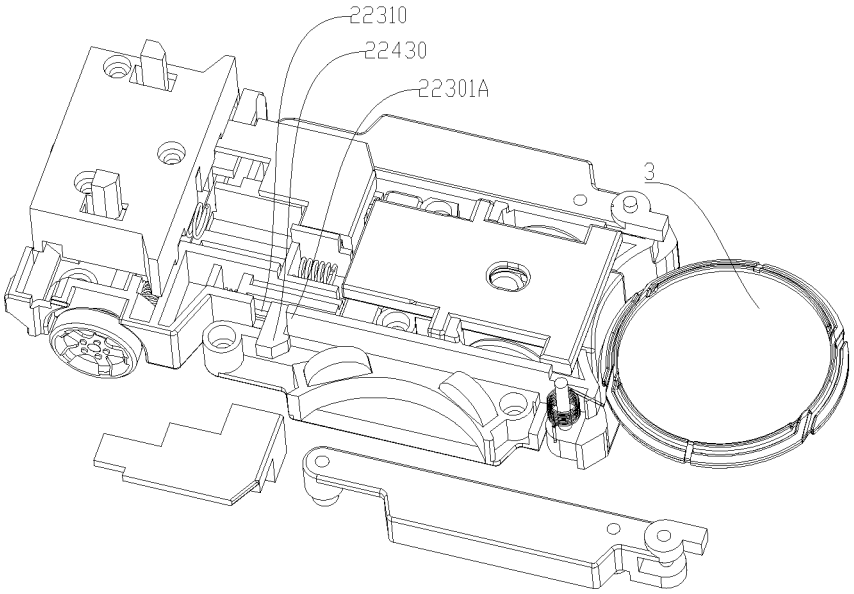
FIG. 9 is another exploded view of the second assembly illustrated in FIG. 4.

Referring to FIG. 7 and FIG. 8, the first layer triggering unit 224 can include a first layer magnetic attraction member 2241, a first layer front moving member 2242, and a first layer rear moving member 2243. The first layer magnetic attraction member 2241 is fixed to the supporting member 21, the first layer front moving member 2242 can be disposed to the supporting member 21 and movable forwards and backwards. The first layer rear moving member 2243 can be disposed to the supporting member 21 and movable forwards and backwards, and located at a rear side of the first layer front moving member 2242. In combination with FIG. 16, a left side and a right side of the first layer rear moving member 2243 are separately provided with an arm locking member 22430 configured to lock the triggering subassembly 22 in the arm folded state. That is, the triggering arm 2231 is provided with a locking opening 22310, and when the arm locking member 22430 extends into the locking opening 22310, an edge 22310A of the locking opening 22310 can be locked (as illustrated in FIG. 9), so that the triggering arm 2231 can be locked in an arm folded position. When the first layer magnetic attraction member 2241 attracts a magnetic body (e.g. the magnetic coin 3) to push the first layer front moving member 2242 to move backwards, the first layer front moving member 2242 pushes the first layer rear moving member 2243 to move backwards; and during backward movement of the first layer rear moving member 2243, the limit to the edge 22310A of the locking opening 22310 by means of the arm locking member 22430 is released, so that the triggering arm unit 223 is released to perform the arm unfolding movement. Thus, the first layer triggering unit 224 has a simple structure and high action reliability.

Referring to FIG. 15 and FIG. 16, the second layer triggering unit 225 can include a second layer front moving member 2251 and a second layer rear moving member 2252. The second layer front moving member 2251 can be disposed to the supporting member 21 and movable forwards and backwards, the second layer rear moving member 2252 can be disposed to the supporting member 21 and movable forwards and backwards, and located at a rear side of the second layer front moving member 2251. The second layer rear moving member 2252 is provided with a stop rod 222 configured to lock the unfolding subassembly 23 in a folded state. When the triggering arm unit 223 presents the arm unfolded state, the triggering arm unit 223 pushes the second layer front moving member 2251 to move backwards; and during the backward movement of the second layer front moving member 2251, the second layer rear moving member 2252 is pushed to move backwards, in this case, the constraint action on the hook member 236 of the unfolding casing 231 by the stop rod 222 can be released so that the stop rod 222 can release the unfolding subassembly 23 and enable the unfolding subassembly 23 to be unfolded. Thus, the second layer triggering unit 225 has a simple structure and high action reliability.

Preferably, a left side and a right side of a front end of the second layer front moving member 2251 are provided with a touching block 22510 separately, a front end of the triggering arm 2231 is provided with a poke block 22311, and during the pivoting of the triggering arm 2231, the poke block 22311 can poke the touching block 22510 to move backwards, thus, the touching reliability can be improved further.

Figure 18:
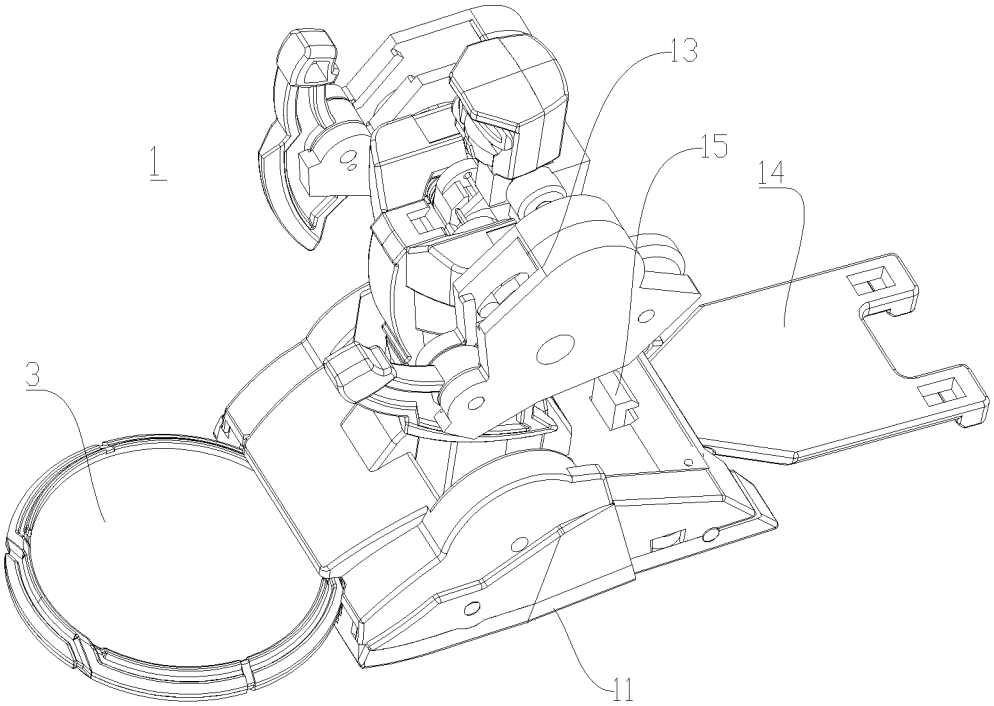
FIG. 18 is a perspective view of the first assembly illustrated in FIG. 17 after deformation.
Figure 19:
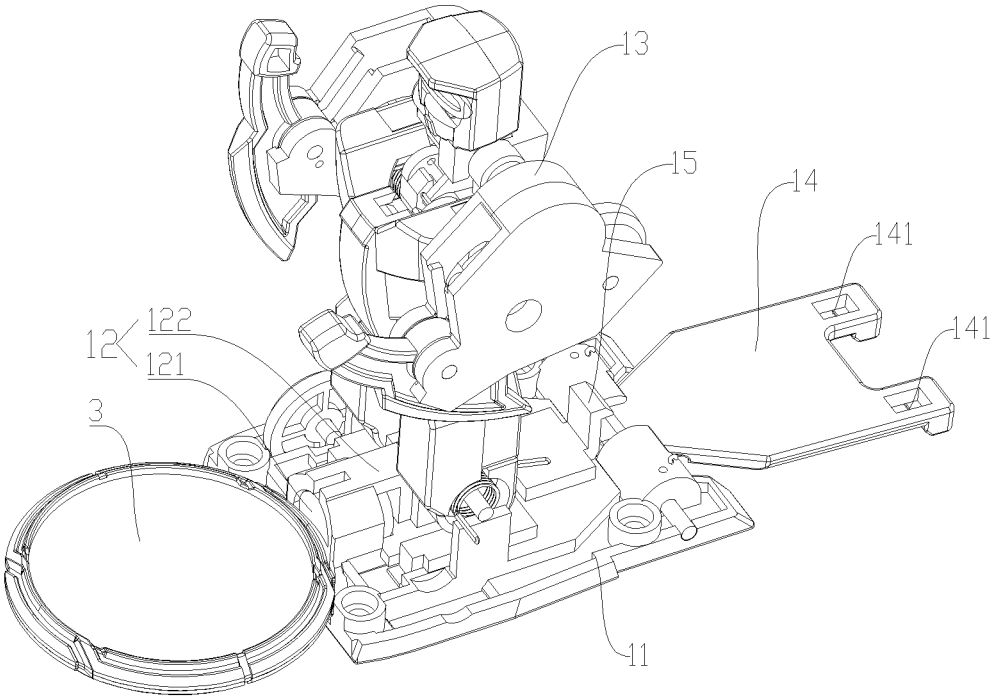
FIG. 19 is an exploded view of the first assembly illustrated in FIG. 17.

Referring to FIG. 17 to FIG. 20, the first assembly 1 can include a fixed member 11, a triggering component 12, an unfolding component 13 and an overturning component 14. Referring to FIG. 19, the triggering component 12 can include a magnet 121 and a moving block 122, and the moving block 122 can have a hook 1221 passing downwards through the fixed member 11. The overturning component 14 is pivotably connected to the fixed member 11. For example, in the examples illustrated in FIG. 19 and FIG. 20, a rear end of the overturning component 14 is pivotably connected to a rear end of the fixed member 11, a front end of the overturning component 14 has a hook locking hole 141 and is locked by the hook 1221 before the overturning so that the front end of the overturning component 14 is attached to a bottom at a front end of the fixed member 11.

When the magnet 121 attracts the magnetic coin 3 in front of the magnet 121, during the process of the magnetic coin 3 moving backwards and approaching the magnet 121, the moving block 122 is pushed to move backwards, and the hook 1221 at the bottom of the moving block 122 also moves backwards so that the locking of the hook locking hole 141 is released. Under the action of an overturning driving member such as a torsion spring or the like, the front end of the overturning component 14 can be overturned from the front to the rear from the bottom of the fixed member 11. Because the overturning component 14 will interact with a supporting surface supporting the overturning component 14 during the downward overturning, under the reaction applied to the overturning component 14 by the supporting surface, the first assembly 1 can jump into the air and do a front somersault, and after landing, the first assembly 1 can continue to move forward under the action of inertial force.

Figure 20:
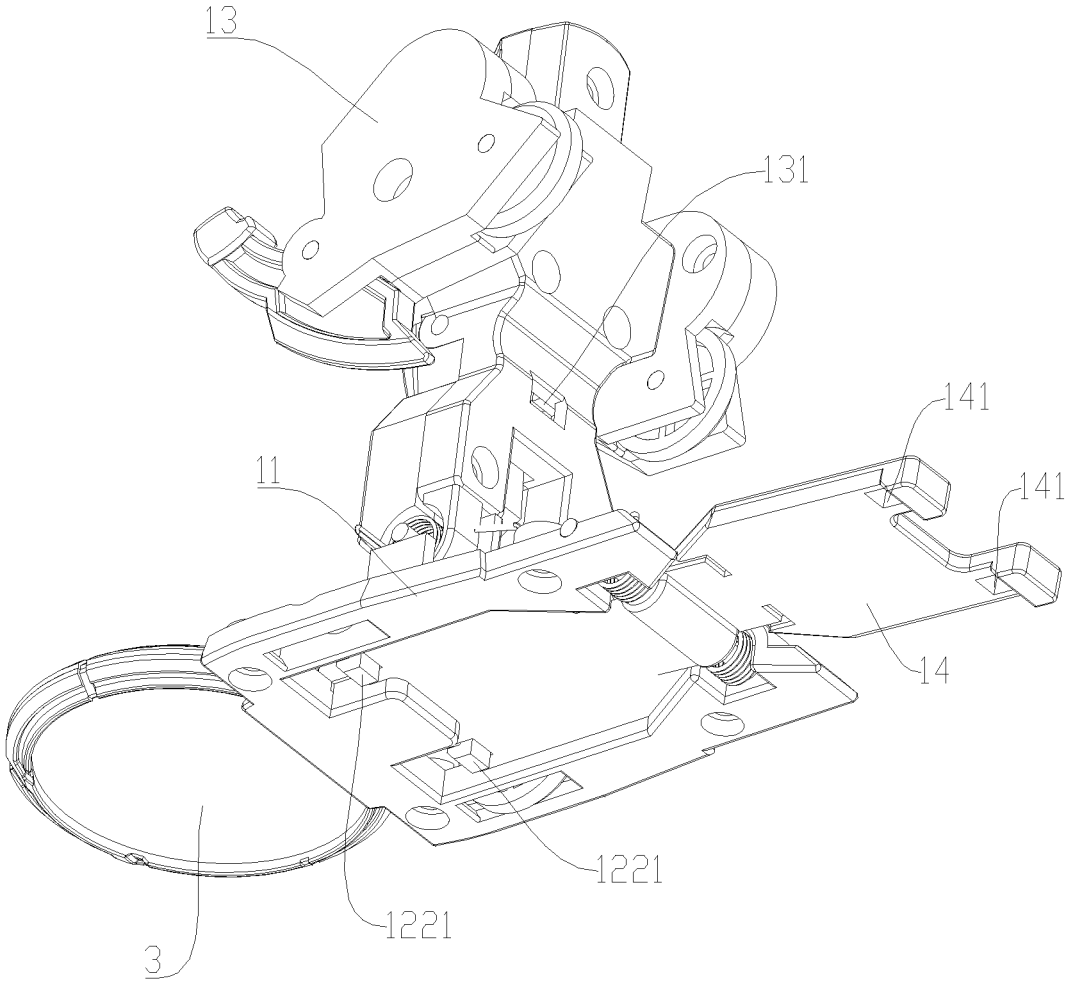
FIG. 20 is another exploded view of the first assembly illustrated in FIG. 17.

Further, referring to FIG. 18 and FIG. 20, the first assembly 1 can further include a hook component 15 disposed to the fixed member 11 and movable forwards and backwards, and the unfolding component 13 is provided with a hook groove 131. When the hook component 15 is hooked to and fitted with the hook groove 131, the unfolding component 13 cannot be unfolded. During the overturning of the overturning component 14, a poke structure of the overturning component 14 can push the hook component 15 to move forwards, in this case, the hook component 15 can be disengaged from the hook groove 131, and various parts of the unfolding component 13 can perform the unfolding actions under the driving action of elastic members.

In the following, referring to FIG. 1 to FIG. 20, a playing method of the child-mother toy 100 according to a specific embodiment of the present disclosure is described briefly.

The child-mother toy 100 is in a shape of a child-mother vehicle as a whole. The second assembly 2 is a mother vehicle, and the first assembly 1 is a child vehicle. In an initial state, the child vehicle is located in the mother vehicle. When the mother vehicle moves forwards, it hits the magnetic coin 3 (or other magnetic body) in the front, and the magnetic coin 3 triggers the mechanical structure inside the mother vehicle to enable the two triggering arms 2231 to unfold and the two unfolding casings 231 to unfold and deform, and to eject the child vehicle hided in the mother vehicle. When the child vehicle is ejected, it hits the magnetic coin 3 (or other magnetic body) in the front, and the magnetic coin 3 triggers the mechanical structures inside the child vehicle and enables the child vehicle to overturn in the air and deform.

In the following, referring to FIG. 1 to FIG. 20, a principle of operations of the child-mother toy 100 in the above-mentioned specific embodiment is described in detail.

When the mother vehicle accommodating the child vehicle moves forwards and hits the magnetic coin 3 arranged in front of the mother vehicle, the first layer magnetic attraction member 2241 attracts the magnetic coin 3 to move backwards, the first layer front moving member 2242 is pushed to move backwards and pushes the first layer rear moving member 2243 to move backwards, the triggering arm 2231 is released by the arm locking member 22430 of the first layer rear moving member 2243, and the two triggering arms 2231 pivot forwards to unfold and attract the magnetic coin 3 through the corresponding arm side magnetic attraction member 2233, so as to realize a plurality of coin clamping of the mother vehicle.

During the unfolding of the two triggering arms 2231, two poke blocks 22311 push the second layer front moving member 2251 to move backwards, the second layer front moving member 2251 pushes the second layer rear moving member 2252 to move backwards, and the second layer rear moving member 2252 drives the stop rod 222 to move backwards to release the hook member 236 on the unfolding casing 231, in this case, the unfolding casing 231 can be unfolded under the driving action of the third driving member 233 and/or the fourth driving member 235.

During the unfolding of the unfolding casing 231, an extending portion 2422 of the locking member 242 is poked by the triggering block 230 so as to make the locking member 242 to move towards the unlocked position. When the side arm 24210 of the locking member 242 completely moves out of the limit groove 2412 of the ejection member 241, the ejection member 241 is unlocked, and under the action of the first driving member 243, the ejection member 241 can move forwards and eject the child vehicle forwards out of the mother vehicle.

The ejected child vehicle hits the magnetic coin 3 in front of the child vehicle, and the magnetic coin 3 is attracted to move backwards by means of the magnet 121, and the magnetic coin 3 can push the moving block 122 and the hook 1221 to move backwards, so as to release 141 of the overturning component 14. In this case, the overturning component 14 can overturn so as to enable the child vehicle to do the front somersault as a whole, and meanwhile, the overturning component 14 can push the hook component 15 to move forwards so as to release the hook groove 131 of the unfolding component 13, and in this case, the unfolding component 13 can be unfolded to enable the child vehicle to finish the somersault and deformation.

In summary, the child-mother toy 100 according to the above-mentioned specific embodiment of the present disclosure realizes complex and continuous actions with normal material and simple mechanical principle, which not only improves the entertainment of the child-mother toy 100, but also enables the number of parts to be less and the structures to be simple, reducing the manufacturing cost of the product effectively and facilitating the quantity production of the product, and during the manufacturing and assembly of the product, the defective rate of the product is reduced effectively, so large quantities of purchasing is suitable. In addition, when the child-mother toy 100 is processed with transparent material, as the child-mother toy 100 has a simple structure, the player can know the internal configuration of the child-mother toy 100 at a glance, so that players, such as children, can understand simple mechanical principles and increase knowledge while playing.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

In the description of the present specification, the description with reference to the terms "an embodiment," "some embodiments," "one embodiment", "another example," "an example," "a specific example," or "some examples" and the like means a specific feature described in connection with the embodiment or example. A structure, material or feature is included in at least one embodiment or example of the disclosure. In the present specification, the schematic representation of the above terms is not necessarily directed to the same embodiment or example. Furthermore, the particular features, structures, materials, or characteristics described may be combined in a suitable manner in any one or more embodiments or examples. In addition, various embodiments or examples described in the specification and features of various embodiments or examples may be combined and combined without departing from the scope of the disclosure.

Although explanatory embodiments have been shown and described, it would be appreciated by those skilled in the art that the above embodiments cannot be construed to limit the present disclosure, and changes, alternatives, and modifications can be made in the embodiments without departing from principles and scope of the present disclosure.

What is claimed is:

1. A child-mother toy, comprising:

a first assembly; and a second assembly comprising a supporting member, a triggering subassembly, an unfolding subassembly and an ejection subassembly, the triggering subassembly, the unfolding subassembly and the ejection subassembly being disposed to the supporting member, the second assembly having a longitudinal direction extending in a front/rear direction and a left/right direction extending perpendicular to the longitudinal direction, wherein before the triggering subassembly is triggered, the unfolding subassembly is folded at the supporting member so as to define an accommodating cavity together with the supporting member, the accommodating cavity is configured to accommodate the first assembly therein; and after the triggering subassembly is triggered, the unfolding subassembly is unfolded to open the accommodating cavity, and meanwhile the ejection subassembly ejects the first assembly out of the accommodating cavity, wherein the unfolding subassembly comprises two unfolding casings pivotably connected to a left side edge and a right side edge of the supporting member separately, when the two unfolding casings are pivoted towards a top of the supporting member and in a direction of approaching each other, said casings are folded, and when the two unfolding casings are pivoted away from each other, said casings are unfolded;

wherein the ejection subassembly comprises:

an ejection member disposed to the supporting member and movable forward and backward between an ejected position and a retracted position by means of a first driving member; and a locking member disposed to the supporting member and movable leftwards and rightwards between a locked position and an unlocked position by means of a second driving member, wherein when the locking member is located in the locked position, the ejection member is locked in the retracted position by means of the locking member, and when the locking member moves to the unlocked position, the ejection member is released by means of the locking member so as to enable the ejection member to be ejected;

wherein a side wall of the ejection member in a left-and-right direction is provided with two limit blocks spaced apart in a front-and-rear direction, and a limit groove is defined between the two limit blocks, wherein the locking member comprises an annular portion having an axis extending in the front-and-rear direction so that the annular portion is fitted over the ejection member, and wherein when the locking member is located in the locked position, a side arm of the annular portion in the left-and-right direction is fitted into the limit groove, and when the locking member moves to the unlocked position, the side arm moves out of the limit groove to be released.

2. The child-mother toy according to claim 1, wherein an outer side surface of a rearward limit block of the two limit blocks is configured as a guiding surface extending obliquely towards a longitudinal center line of the ejection member from front to rear, and during a movement of the ejection member from the ejected position to the retracted position from the front to the rear, the guiding surface guides the side arm into the limit groove.

3. The child-mother toy according to claim 2, wherein the first assembly comprises a fixed member, a triggering component, an unfolding component and an overturning component; the triggering component, the unfolding component and the overturning component are disposed to the fixed member; the unfolding component is unfolded when the triggering component is triggered; the overturning component is driven to pivot during unfolding of the unfolding component, and the first assembly is driven to turn over in the air during pivoting of the overturning component.

4. The child-mother toy according to claim 1, wherein a side surface of the supporting member in the left-and-right direction has a notch, the locking member comprises an extending portion connected with the annular portion and capable of extending out of the supporting member through the notch, the unfolding subassembly comprises a triggering block, and during unfolding of the unfolding subassembly, the triggering block pushes the extending portion to move towards an interior of the supporting member along the notch, and the extending portion drives the side arm to move outwards from the limit groove.

5. The child-mother toy according to claim 4, wherein the first assembly comprises a fixed member, a triggering component, an unfolding component and an overturning component; the triggering component, the unfolding component and the overturning component are disposed to the fixed member; the unfolding component is unfolded when the triggering component is triggered; the overturning component is driven to pivot during unfolding of the unfolding component, and the first assembly is driven to turn over in an air during pivoting of the overturning component.

6. The child-mother toy according to claim 1, wherein a third driving member is provided where each unfolding casing and the supporting member are pivotably jointed, and the third driving member applies force to the unfolding casing so as to enable the unfolding casing to tend to be unfolded.

7. The child-mother toy according to claim 6, wherein the first assembly comprises a fixed member, a triggering component, an unfolding component and an overturning component; the triggering component, the unfolding component and the overturning component are disposed to the fixed member; the unfolding component is unfolded when the triggering component is triggered; the overturning component is driven to pivot during unfolding of the unfolding component, and the first assembly is driven to turn over in an air during pivoting of the overturning component.

8. The child-mother toy according to claim 1, wherein a bouncing rod is disposed at an inner side of each unfolding casing, an end of the bouncing rod is pivotably connected to the corresponding unfolding casing, a fourth driving member is disposed between the bouncing rod and an inner surface of the unfolding casing, and the fourth driving member applies force to another end of the bouncing rod in a direction away from the corresponding unfolding casing so as to enable the corresponding unfolding casing to tend to be unfolded.

9. The child-mother toy according to claim 8, wherein the first assembly comprises a fixed member, a triggering component, an unfolding component and an overturning component; the triggering component, the unfolding component and the overturning component are disposed to the fixed member; the unfolding component is unfolded when the triggering component is triggered; the overturning component is driven to pivot during unfolding of the unfolding component, and the first assembly is driven to turn over in an air during pivoting of the overturning component.

10. The child-mother toy according to claim 1, wherein the unfolding subassembly comprises a hook member having a hook groove opened at a rear side, the triggering subassembly comprises:

a stop block having a stop hole penetrating the stop block along an up-and-down direction;

a stop rod passing through the stop hole from bottom to top, wherein when the stop rod moves to a front limit position of the stop hole, the stop rod is fitted into the hook groove so as to lock the unfolding subassembly in a folded state, and when the limit rod moves backwards along the stop hole, the stop rod moves backwards out of the hook groove so as to release the unfolding subassembly to enable the unfolding subassembly to be unfolded.

11. The child-mother toy according to claim 10, wherein the first assembly comprises a fixed member, a triggering component, an unfolding component and an overturning component; the triggering component, the unfolding component and the overturning component are disposed to the fixed member; the unfolding component is unfolded when the triggering component is triggered; the overturning component is driven to pivot during unfolding of the unfolding component, and the first assembly is driven to turn over in an air during pivoting of the overturning component.

12. The child-mother toy according to claim 1, wherein the triggering subassembly comprises a triggering arm unit, a first layer triggering unit and a second layer triggering unit, the triggering arm unit is disposed to a left side and/or a right side of the supporting member, and the first layer triggering unit is disposed to an upper side and/or a lower side of the second layer triggering unit, wherein when the first layer triggering unit is triggered, the first layer triggering unit triggers the triggering arm unit to perform arm unfolding, and during the arm unfolding of the triggering arm unit, the second layer triggering unit is triggered to act to unfold the unfolding subassembly.

13. The child-mother toy according to claim 12, wherein the triggering arm unit comprises two triggering arms, and the two triggering arms are disposed to the left side and the right side of the supporting member separately and have an end pivotably connected to the supporting member respectively.

14. The child-mother toy according to claim 13, wherein the triggering arm is provided with an arm side holding opening, and the triggering arm is provided with a magnetic attraction member therein so as to enable a magnetic body to be held at the arm side holding opening.

15. The child-mother toy according to claim 14, wherein the first assembly comprises a fixed member, a triggering component, an unfolding component and an overturning component; the triggering component, the unfolding component and the overturning component are disposed to the fixed member; the unfolding component is unfolded when the triggering component is triggered; the overturning component is driven to pivot during unfolding of the unfolding component, and the first assembly is driven to turn over in an air during pivoting of the overturning component.

16. The child-mother toy according to claim 13, wherein the first assembly comprises a fixed member, a triggering component, an unfolding component and an overturning component; the triggering component, the unfolding component and the overturning component are disposed to the fixed member; the unfolding component is unfolded when the triggering component is triggered; the overturning component is driven to pivot during unfolding of the unfolding component, and the first assembly is driven to turn over in an air during pivoting of the overturning component.

17. The child-mother toy according to claim 12, wherein the first layer triggering unit comprises:

a first layer magnetic attraction member fixed to the supporting member;

a first layer front moving member disposed to the supporting member and movable forwards and backwards;

a first layer rear moving member disposed to the supporting member and movable forwards and backwards, and located at a rear side of the first layer front moving member, wherein a left side and a right side of the first layer rear moving member are separately provided with an arm locking member configured to lock the triggering subassembly in an arm folded state; when the first layer magnetic attraction member attracts a magnetic body to push the first layer front moving member to move backwards, the first layer front moving member pushes the first layer rear moving member to move backwards; and during backward movement of the first layer rear moving member, the triggering arm unit is released to enable the triggering arm unit to perform the arm unfolding.

18. The child-mother toy according to claim 12, wherein the second layer triggering unit comprises:

a second layer front moving member disposed to the supporting member and movable forwards and backwards, a left side and a right side of a front end of the second layer front moving member being provided with a touching block separately;

a second layer rear moving member disposed to the supporting member and movable forwards and backwards, and located at a rear side of the second layer front moving member, wherein the second layer rear moving member is provided with a stop rod configured to lock the unfolding subassembly in a folded state; during the arm unfolding of the triggering arm unit, the triggering arm unit pushes the touching block backwards so as to make the second layer front moving member move backwards; and during the backward movement of the second layer front moving member, the second layer rear moving member is pushed to move backwards so as to make the stop rod release the unfolding subassembly and enable the unfolding subassembly to be unfolded.

19. The child-mother toy according to claim 12, wherein the first assembly comprises a fixed member, a triggering component, an unfolding component and an overturning component; the triggering component, the unfolding component and the overturning component are disposed to the fixed member; the unfolding component is unfolded when the triggering component is triggered; the overturning component is driven to pivot during unfolding of the unfolding component, and the first assembly is driven to turn over in an air during pivoting of the overturning component.

20. The child-mother toy according to claim 1, wherein the first assembly comprises a fixed member, a triggering component, an unfolding component and an overturning component; the triggering component, the unfolding component and the overturning component are disposed to the fixed member; the unfolding component is unfolded when the triggering component is triggered; the overturning component is driven to pivot during unfolding of the unfolding component, and the first assembly is driven to turn over in an air during pivoting of the overturning component.

* * * * *